US005572931A

United States Patent [19]

Lazar et al.

[11] Patent Number: 5,572,931

[45] Date of Patent: Nov. 12, 1996

[54] RAILCAR TRUCK BEARING ADAPTER CONSTRUCTION

[75] Inventors: Glen F. Lazar, Palatine; V. Terrey Hawthorne, Lisle; Norman A. Berg, Wheaton, all of Ill.

[73] Assignee: Amsted Industries Incorporated, Chicago, Ill.

[21] Appl. No.: 351,775

[22] Filed: Dec. 8, 1994

[51] Int. Cl.[6] ..... B61F 5/00

[52] U.S. Cl. ..... 105/219; 105/218.1

[58] Field of Search ..... 105/218.1, 218.2, 105/219, 225, 224.1, 206.1, 220

[56] References Cited

U.S. PATENT DOCUMENTS

| | | | |
|---|---|---|---|
| 1,523,793 | 1/1925 | Stertzbach et al. | 105/219 |
| 1,871,778 | 8/1932 | Clasen | 105/218.1 |
| 2,486,123 | 10/1949 | Cottrell | 105/219 |
| 3,211,112 | 10/1965 | Baker . | |
| 3,274,955 | 9/1966 | Thomas . | |
| 3,276,395 | 10/1966 | Heintzel . | |
| 3,381,629 | 5/1968 | Jones . | |
| 3,621,792 | 11/1971 | Lisch . | |
| 3,699,897 | 10/1972 | Sherrick . | |
| 4,030,424 | 6/1977 | Garner et al. . | |
| 4,034,681 | 7/1977 | Neumann et al. . | |
| 4,072,112 | 2/1978 | Wiebe . | |
| 4,078,501 | 3/1978 | Neumann et al. . | |
| 4,082,043 | 4/1978 | Hammonds et al. . | |
| 4,103,623 | 8/1978 | Radwill . | |
| 4,103,624 | 8/1978 | Hammonds et al. . | |
| 4,108,080 | 8/1978 | Garner et al. . | |
| 4,192,240 | 3/1980 | Korpics . | |
| 4,242,966 | 1/1981 | Holt et al. . | |
| 4,416,203 | 11/1983 | Sherrick . | |
| 4,428,303 | 1/1984 | Tack . | |
| 4,841,875 | 6/1989 | Corsten et al. . | |

OTHER PUBLICATIONS

Car and Locomotive Cyclopedia (1974) Centennial Edition, p. # S1–25.

"Truck Hunting in the Three–Piece Freight Car Truck", by V. T. Hawthorne Aug./1979, ASME, 18 pages.

*Primary Examiner*—Mark T. Le

*Attorney, Agent, or Firm*—Edward J. Brosius; F. S. Gregorczyk; Stephen J. Manich

[57] ABSTRACT

An integrally cast bearing adapter arrangement is provided in the pedestal of a railcar truck side frame, which side frame is cast with a pedestal jaw having a roof, and vertical walls of a first and second leg which roof and walls operate as a bearing adapter to receive a bearing assembly for an axle end without introducing the manufacturing and assembly tolerances from discrete component assemblies, thereby avoiding the lateral displacement associated with the added tolerances and operating to minimize angular displacement between each mated axle and side frame.

11 Claims, 2 Drawing Sheets

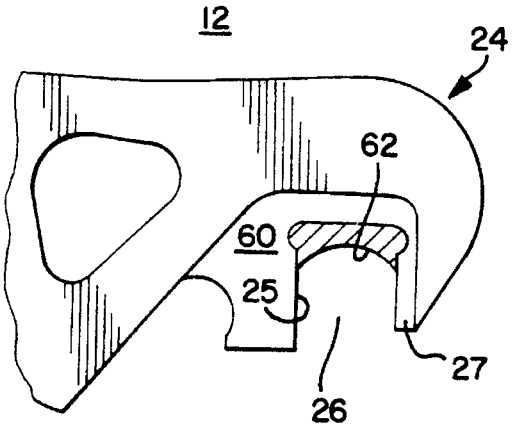
FIG. 1
FIG. 2
PRIOR ART
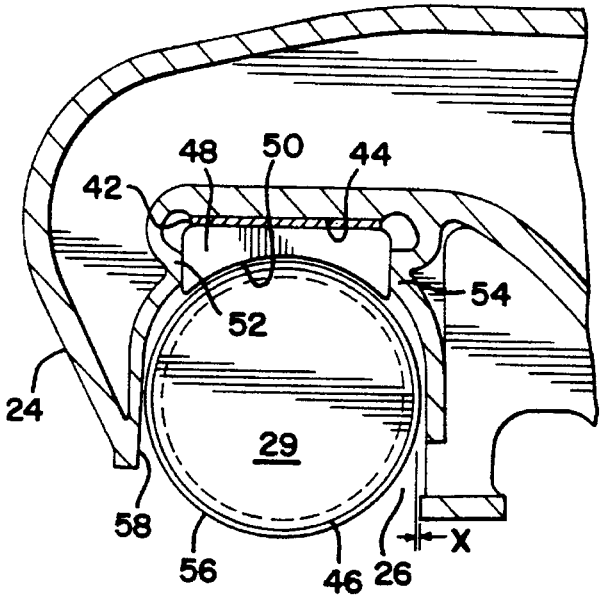
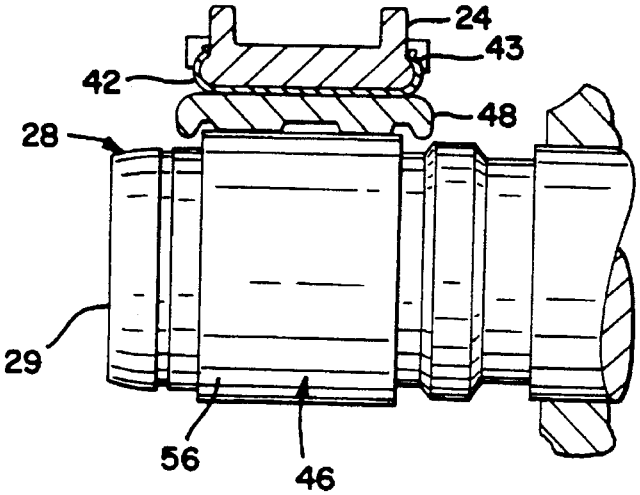
FIG. 3
PRIOR ART

FIG. 4
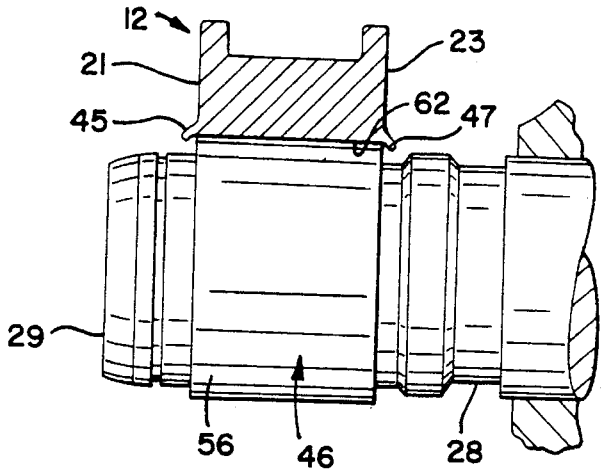
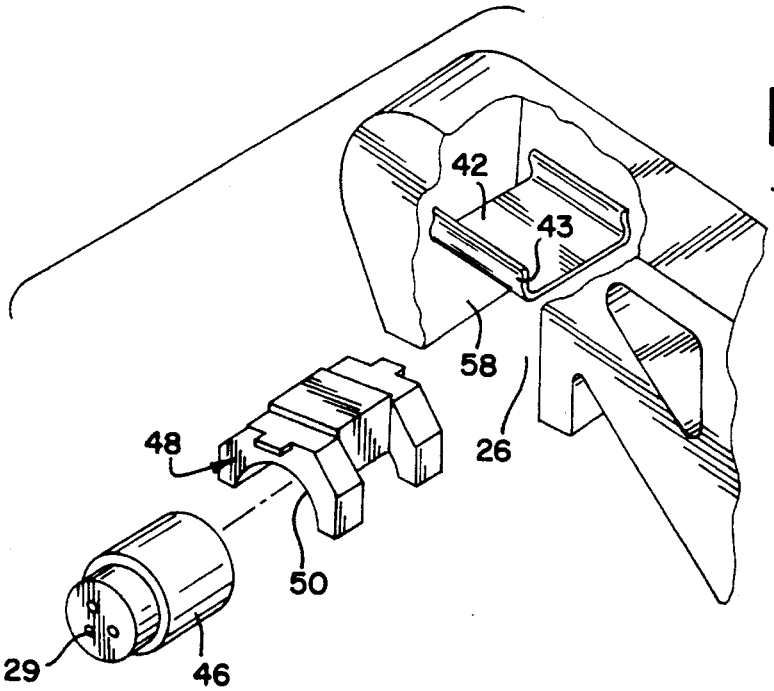
FIG. 5
PRIOR ART
FIG. 6
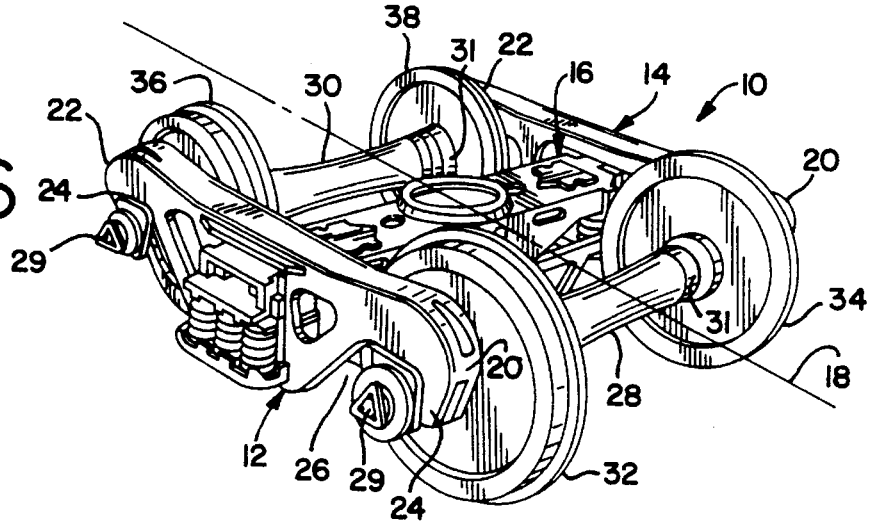

RAILCAR TRUCK BEARING ADAPTER CONSTRUCTION

BACKGROUND OF THE INVENTION

1. Field of the Invention

The present invention relates to a bearing adapter assembly for a railcar truck. More specifically, tightly secured bearing adapters firmly hold the axle bearing in position to avoid angling and lateral axle variation, and the resultant truck "warping". Past research has illustrated railcar truck warping induces truck hunting during railcar travel, which warping causes undue wear on rails and wheels as well as increasing fuel usage.

2. Description of the Prior Art

In a three-piece railcar truck assembly, the side frames and bolster are generally square, that is the axles and bolster are approximately parallel to each other, and the side frames are parallel to each other but normal to the axles and bolster. After truck assembly and at certain railcar speeds, the truck may become dynamically unstable, which may be loosely defined as truck hunting. Truck hunting is defined in the Car and Locomotive Cyclopedia (1974) as "an instability at high speed of a wheel set (truck), causing it to weave down the track, usually with the (wheel) flanges striking the rail." Truck hunting has been the subject of many past and ongoing research efforts within the rail industry by truck suppliers, car builders and railroad lines, as this condition is undesirable from both operational and safety considerations. Past research efforts have noted a significant relationship between truck warping and resultant truck hunting. These research efforts and some of their conclusions are discussed in the ASME paper, "Truck Hunting in the Three-Piece Freight Car Truck" by V. T. Hawthorne, which paper included historical reference to still earlier research in this field. One of the earlier researchers noted ". . . that in the empty car the higher column force of the constant column damping provides a greater warp stiffness and, consequently, yields a higher critical (truck) hunting speed." The ASME paper described a project that was designed to measure the following parameters: warp stiffness; lateral damping force; and, lateral spring rate.

The warp stiffness results in this Hawthorne project duplicated earlier test results and it was noted that as the warp angle increased to 1° (60 minutes) of angular displacement, the warp stiffness dropped off appreciably. Further, it was noted that earlier warp stiffness data showed that 1° of displacement represented the maximum warp travel of a relatively new truck during hunting. Therefore, at warp angles prevalent in truck hunting, the warp stiffness fell considerably below the values necessary to raise the critical speed of hunting above the normal operating range of the freight railcar.

A field test noted that a new railcar truck running at a speed above 60 miles per hour with track inputs causing warp angles below 0.3° would not be expected to hunt. However, if the warp angle suddenly became 1.0° due to a track irregularity, it is expected that the critical truck hunting speed of the railcar would drop to about 52 miles per hour and intermittent truck hunting would occur.

A three-piece railcar truck generally allows a considerable amount of relative movement between the wheel and axle assembly, or the wheelset which includes the axle, wheels and the bearings, and the supporting side frame at the side-frame pedestal jaw. This may be due to manufacturing tolerances permitted in the various components, that is the side-frame pedestal jaw and bearing adapter, and to the form of the connection for the bearing adapter, the journal end of the wheelset and the integral jaws of the side frame structure. U.S. Pat. No. 3,211,112 to Baker discloses an assembly to damp the relative lateral movement between the wheel and axle assembly, and the associated side frame. More specifically, a resilient means or member is provided between the top of the journal end of the wheel and axle assembly, and the associated side frame member to produce varying frictional forces for damping the relative movement between the assembly and the side frame. The Baker-'112 patent recognized the undesirability of transmitting track perturbations through the wheelset, side frames and bolsters, but inhibition of this force transmission is intended to be accomplished by damping the disturbances caused by the lateral axle movements, not by suppressing their initiation.

In U.S. Pat. No. 3,274,955 to Thomas and also in U.S. Pat. No. 3,276,395 to Heintzel, a roller bearing adapter is illustrated with an elastomer on the upper part of the cap plate, which adapter is positioned in the side frame pedestal jaw with the elastomer between the pedestal roof and the adapter for relieving exposure to high stresses. A similar concept is shown in U.S. Pat. No. 3,381,629 to Jones, which provided an elastomeric material between each bearing assembly and the pedestal roof to accommodate axial movements of the bearing assemblies of each axle and to alleviate lateral impact to the side frame.

Other means have been utilized for maintaining a truck in a square or parallel relationship. In U.S. Pat. No. 4,103,623 -Radwill, friction shoes are provided to frictionally engage both the side frame column and bolster. This friction shoe arrangement is intended to increase the restraining moment, which is expected to result in an increased truck hunting speed. The friction shoes had contact surfaces with some appropriate manufacturing tolerance to control initial contact areas to develop a maximum restraining moment.

U.S. Pat. No. 4,192,240 to Korpics provided a wear liner against the roof of a side-frame pedestal jaw. The disclosure recognized the detrimental effects of having a loose wear liner in the pedestal jaw. Wear liners are provided against the roof of the pedestal jaw to reduce wear in the roof caused by oscillating motions of the side frame relative to the wheel-axle assembly and the bearing. The disclosed wear liner included upwardly projecting tabs to grip the roof and side frame to inhibit longitudinal movement of the wear liner, and downwardly projecting legs to cooperate with the pedestal-jaw stop lugs to inhibit lateral movement of the wear liner relative to the roof. The stop lugs of the pedestal jaw are positioned on opposite sides of the depending legs of the jaw, which lugs are engageable with the downwardly depending wear liner legs.

U.S. Pat. No. 3,621,792 to Lisch provides a pedestal jaw opening with outwardly sloped sidewalls and a bearing adapter with sloped sidewalls positioned in the jaw opening. An elastomeric is positioned between the adapter and the pedestal sidewall and roof, which elastomer provides resistance in compression and yieldability in shear, and sufficient softness for cushioning. It is noted that by positioning the elastomeric pad between all the interfaces of the adapter and the pedestal jaw, metal-to-metal contact is prevented along with wear and transmission of noise and vibration from the track to the truck framing. Similarly in U.S. Pat. Nos. 3,699,897 and 4,416,203 to Sherrick, a resilient pad is provided between the bearing adapter and the side frame.

In U.S. Pat. No. 4,072,112 to Wiebe, an elastomeric positioning means is placed intermediate the bearing carrier and one of the pedestal jaws to bias the bearing carrier into direct communication or engagement with the opposite pedestal jaw to limit relative angular movement and linear displacement of the wheel set to the side frame.

U.S. Pat. Nos. 4,108,080 and 4,030,424 to Garner et al. teach a rigid H-frame truck assembly having resilient journal pads in the pedestal jaws. The truck provided by this development demonstrated improved riding characteristics. Similarly U.S. Pat. Nos. 4,082,043 and 4,103,624 to Hammonds et al. disclose an integral H-frame truck with resilient elements in the journal bearings.

In U.S. Pat. No. 4,242,966 to Holt et al., a railcar truck has a transom with a pair of tubes rigidly connected between the longitudinally extending side frames. The transom allows vertical movement of the side frames but resists longitudinal displacement of the side frames with respect to each other.

U.S. Pat. No. 4,841,875 to Corsten et al. provides a suspension arrangement with at least two annular elastomeric shock absorbers having an optimum adjustability in the longitudinal and transverse directions of the vehicle.

Alternative means for the insertion and securing of a wear liner against a pedestal jaw roof are taught in U.S. Pat. Nos. 4,034,681 and 4,078,501 to Neumann et al. and U.S. Pat. No. 4,192,240 to Korpics, which patents have a common assignee. The objective of these patent disclosures was to provide improved means for securing a wear liner in the jaw to minimize its movement and to improve the assembly means. The wear liners are provided with downwardly depending legs and stop lugs positioned to inhibit movement of the wear liner, such as in the lateral direction relative to the roof.

U.S. Pat. No. 4,428,303 to Tack illustrates a clip-on pedestal wear plate especially adapted for worn pedestal surfaces. A pair of wear plates, or a single member with a central portion of the plate removed, may be used to provide the structure of the invention.

All of the above disclosed apparatus disclose a journal assembly or an assembly for a railcar truck axle end, which assembly is operable in the pedestal jaw, and the disclosures recognized the desirability of keeping the truck side frames aligned with each other to avoid truck hunting. However, the several disclosures provided a plurality of resilient means or structures in the pedestal jaw and around the axle journal bearings, but none of the structures addressed the problem of maintaining the bearing adapter and consequently the axle and side frames in their aligned positions. Several of the above-noted references specifically utilized elastomeric or resilient components in the pedestal jaw or in association with the journal bearing to accommodate the disturbances and flexing motions experienced by the axles and side frames.

SUMMARY OF THE INVENTION

Side frames for a railcar truck have pedestals at both of its longitudinal ends with jaws to receive the journal ends of the axle shafts. These journal are generally provided with wheel bearings, which are mounted and secured in bearing adapters positioned in the pedestal jaws with the intent that the axles, usually two, of the truck remain aligned and parallel during railcar travel. The above-noted bearing adapters are generally secured in the pedestal jaw by means such as interlocking surfaces and frequently are provided with wear plates positioned between the adapter and the pedestal jaw roof to minimize wear from the repeated flexing of the adapter in the jaw during railcar travel.

The present invention provides an integrally cast bearing adapter in the roof of the pedestal jaw, which adapter is cast with the side frame and pedestal jaw and thereafter may be precision machined or otherwise finished. This secondary finishing accommodates the journal bearing on the axle end, avoids the build up of manufacturing tolerances from the assembly of a multiplicity of parts, and minimizes the flexural displacement in the jaw and bearing to more narrowly limit the lateral displacement of the axle and side frame assemblies to reduce railcar truck warping and consequent truck hunting. This integral jaw and bearing assembly reduces the lateral angular displacement below 1°, and in a preferred embodiment the displacement is less than 0.35°. It is recognized that truck hunting is not eliminated per se, but at the reduced angling and angles of lateral displacement, and thus reduced frequency of vibration, the critical speed, where truck hunting becomes a negative operating factor, is increased beyond the normal operating speed of the railcar.

BRIEF DESCRIPTION OF THE DRAWINGS

In the figures of the Drawing, like reference numerals identify like components and in the drawings:

FIG. 1 is a side elevation view of a side frame and pedestal jaw with the as-cast and machined bearing adapter highlighted with sectional lines;

FIG. 2 is a side elevation view of an exemplary prior art side-frame pedestal jaw with the wear plate, bearing adapter and axle end positioned therein;

FIG. 3 is a cross-sectional view of a pedestal jaw, wear plate and bearing adapter with an axle and journal bearing positioned therein;

FIG. 4 is a cross-sectional view of the pedestal jaw and machined bearing adapter of the present invention with the axle and journal bearing positioned therein;

FIG. 5 is an exploded view of an exemplary prior art pedestal jaw, wear liner, bearing adapter and journal bearing assembly; and, FIG. 6 is an oblique view of a railcar truck.

DETAILED DESCRIPTION OF THE PREFERRED EMBODIMENT

A railcar truck 10 as illustrated in FIG. 6 is generally an assembly of three main components, that is a first side frame 2, a second side frame 14 and a bolster 16 extending therebetween at about the midpoints of parallel side frames 12 and 14, which bolster 16 is about normal to each of side frames 2 and 14. Each of side frames 12 and 14 are about parallel to longitudinal axis 18 and include first end 20 and second end 22, which ends 20,22 each include a pedestal jaw 24 with a bearing opening 26. As each of the pedestal jaws 24 and bearing openings 26 are similar only one will be described, but the description will be applicable to each of openings 26 and jaws 24 of side frames 12 and 14.

In truck 10, first and second axles 28 and 30, which have wheels 32, 34, 36 and 38 positioned on their respective first axle-end 29 and second axle-end 31, are mounted at the respective first and second ends 20 and 22 of side frames 12 and 14, and extend therebetween about normal to longitudinal axis 18. The various ancillary elements of the truck, such as the spring pack and friction shoes, are not noted but typically are a part of a truck assembly 10.

In FIGS. 2, 3 and 5 enlarged and exploded views of an end of axle shaft 28 note a relatively common type of structure. In FIG. 2, axle shaft end 29 extends through pedestal jaw 24 and opening 26. Wear liner 42 is nested against roof 44 of jaw 24 and, journal bearing and bearing sleeve 46 are an annular bearing assembly, which is slidingly mounted on shaft end 29. Bearing adapter 48 is secured against wear liner 42 between thrust lugs 52 and 54 of jaw 24, which lugs 52, 54 extend into opening 26. Adapter 48 has arcuate surface 50 and is secured in opening 26 between lugs 52 and 54, and against wear liner 42. Journal bearing assembly 46 fits against arcuate surface 50 and is retained in jaw 24 and opening 26.

Indicative of the clearances provided in the assembly of axle end 40, pedestal jaw 24 and opening 26 is the separation 'x' in FIG. 2 between outer surface 56 of journal bearing 46 and the inner wall 58 of opening 26. This clearance is required both for the initial manufacturing process tolerances for the various parts of the assembly and for the purpose of providing adequate clearance for assembly of these parts.

The assembly of FIG. 2 is shown in a longitudinal cross-section in FIG. 3 with roof 44 of pedestal jaw 24 grasped by clips 43 of wear liner 42. Similarly in FIG. 5, the exploded view of axle end 29, journal bearing 46, bearing adapter 48 and wear liner 42 illustrates the plurality of parts in present axle and side frame assemblies. Accumulation of tolerances and clearances from these parts and their assembly provide gap distances in the final structure, which can lead to the amplification or increase in flexing between the axle and side frames during operation of truck 10 and consequently to the introduction of truck hunting.

In FIGS. 1 and 4, the present invention demonstrates the improved structure which leads to the elimination of both independent bearing adapter 48 and wear liner 42, and to a reduction in the lateral angular displacement between axles 28 and side frames 12 and 14. In FIG. 1, a segment of side frame 12 has pedestal jaw 24 with inner pedestal leg 25, outer pedestal leg 27 and bearing adapter 60 outlined in a cross-hatched portion. However, bearing adapter portion 60 is an integral part of the side frame, but it is illustrated in outline form to note its position within pedestal jaw 24 and its relationship to opening 26. In this configuration, bearing adapter 60, which is the functional equivalent of adapter 48 in FIG. 2, is initially cast into side frame 12 and pedestal jaw 24. After casting, adapter 60 is machined, formed or ground to provide the proper finish and arcuate contour at pedestal roof 44, which contoured arc 62 is similar to arc surface 50 of bearing adapter 48.

As illustrated in FIG. 4, journal bearing assembly 46 is securely mated against contoured arc 62 thereby avoiding the build-up of tolerances for each of wear liner 42 and bearing adapter 48. Thus, integrally cast adapter 60 has removed the availability of the manufacturing and assembly specification tolerances of wear liner 42 and bearing adapter 48 for reducing the ability of pedestal jaw 24 and opening 26 to retain and secure the axle 28 relatively tightly against angular displacement, which may lead to a reduction in truck hunting. First outwardly extending flange 45 extends outward from outboard surface 21 of side frame 12 and second outwardly extending flange 47 extends outwardly along axle 28 from inboard surface 23 of side frame 12. Each of flanges 45 and 47 are downwardly curved from roof 62 and are operable to maintain bearing assembly 46 in position on axle end 29. Flanges 45 and 47 are integrally cast with bearing adapter 60.

The magnitude of improvement of the angular displacement of axle 28 has been demonstrated by reduction of displacement from about 1° to less than 0.50° during testing. As noted above in earlier research work, decreasing the angular displacement results in improved truck hunting, or more accurately has been noted to increase the critical speed where truck hunting commences. Therefore, the improvement attributable to this greater or tighter retention of bearing assembly 46, and thus axle 28, is readily apparent, as this avoids truck warping or parallelogramming which reduces truck hunting. Firmer retention of bearing assembly 46 and axle 28 at the side frame cooperates with the improved degree of freedom offered with the modern snubbers or friction shoes (not shown) and bolster 16 assemblies to provide the rigidity and stability to truck assemblies 10 to avoid truck warping without the added structural members from supplemental apparatus, such as steering arms. If it is considered necessary to provide better wear characteristics on surface 62 of jaw 24, arcuate surface 62 may be hardened or coated by means known in the art, such as plasma spraying or plating.

While only a specific embodiment of the invention has been described and shown, it is apparent to those skilled in the art that various alternatives and modifications can be made thereto. It is, therefore, the intention in the appended claims to cover all such modifications and alternatives as may fall within the true scope of the invention.

We claim:

1. In a three-piece railway truck assembly having a first side frame and a second side frame generally parallel to each other, each said first and second side frame having a longitudinal axis, a first end and a second end, a bolster transverse to said side frame longitudinal direction and connecting said first and second side frames, a first axle and a second axle generally parallel to each other and transverse to said longitudinal direction, a plurality of bearing assemblies, each said first and second axle having a first axle end and a second axle end, a journal bearing assembly mounted on each said axle end, each said side frame having a pedestal at each of said side frame first end second ends with an integrally cast jaw, said jaw having a roof, a first depending leg and a second depending leg, each said first and second depending legs generally vertically extending from said roof and having a lower end, said jaw open at said lower end, the improvement comprising:

said jaw roof, first depending leg and second depending leg cooperating to define an integral bearing adapter in said open jaw at each said pedestal end, each said bearing assembly and axle end directly engaging one said bearing adapter and secured in said adapter against angling and lateral movement between said bearing assembly and said pedestal jaw to maintain each said axle and axle end, and an associated mated side-frame end at approximately a fixed position to reduce railcar track warping and consequent railcar truck hunting.

2. In a three-piece railway truck assembly as claimed in claim 1 wherein each said axle has an axle longitudinal axis transverse to said side-frame longitudinal axis, said side-frame and axle longitudinal axes generally intersecting at about right angles at a reference position and cooperating to define a horizontal plane, said pedestal-jaw bearing adapter securing said bearing assemblies and said axles in said side frames at said respective side-frame end and axle end to limit postassembly angular deflection between said axle and side-frame axes to less than 25 minutes of angular displacement in said plane from said right angle reference position to increase a critical speed above a normal operating speed to reduce the onset of truck hunting.

3. In a three-piece railway truck assembly as claimed in claim 1, wherein said side frame with said pedestal, said jaw roof and said first and second depending legs are a single cast structure, said jaw defined by said jaw roof and said first and second depending legs may be provided to finished tolerance dimensions to securely maintain said bearing assembly in said jaw in each said single cast structure by any of forming, casting and machining.

4. In a three-piece railway truck assembly as claimed in claim 1 wherein at least one of said roof and said depending legs of said pedestal jaw further includes a hardened material surface, which surface is flame sprayed with a hardened material to provide a hard wearing surface in said jaw for said bearing assembly.

5. In a three-piece railway truck assembly as claimed in claim 1 wherein at least one of said roof and said depending legs of said pedestal jaw has a hardened material surface, which surface is coated with a hardened material to provide a hard wearing surface in said jaw for said bearing assembly.

6. In a three-piece railway truck assembly as claimed in claim 1 wherein at least one of said roof and said depending legs of said pedestal jaw has a hardened material surface which surface, is air-hardened to provide a hard wearing surface for said bearing assembly.

7. In a three-piece railway truck assembly as claimed in claim 1, wherein each said first and second side frame has an inboard side and an outboard side, said first and second side frame inboard sides in a facing each other;

each said pedestal-jaw roof of each said side frame having a first curved retaining flange generally perpendicular to said side frame longitudinal axis and extending outwardly from said outboard side and downwardly toward said axle from said roof, and a second curved retaining flange generally-perpendicular to said side frame longitudinal axis and extending inward along said axle from said inboard side toward the other of said first and second side frame inboard sides and downward toward said axle, said flanges operable to inhibit lateral movement of said bearing assembly on said axle.

8. A side frame of a railcar truck, said side frame having a first end and a second end, an inboard surface, an outboard surface, a longitudinal axis, a first pedestal at said first end, and a second pedestal at said second end, an integrally cast bearing adapter at each said side frame pedestal first end and second end, each said bearing adapter being provided for directly engaging a journal bearing assembly on an axle end, each said side-frame pedestal first and second end having a first and generally vertical depending leg, a second and generally vertical depending leg and a jaw roof connecting said first and second legs, said jaw roof, first depending leg and second depending leg cooperating to define a pedestal jaw and an opening generally opposite said roof, each of said roof, said first depending leg and said second depending leg having an inner wall, said inner walls cooperating to form said bearing adapter to receive and secure said bearing assembly and axle end in said opening to maintain said axle end and bearing in an approximately fixed relationship with a bearing assembly on a second end of said axle positioned in a second side frame opposite and generally parallel to said first side frame.

9. A side frame of a railcar truck as claimed in claim 8, wherein said jaw roof has an arc contoured inner wall, said bearing assembly having a generally cylindrical outer surface, said jaw roof inner wall are contour matable with said bearing assembly outer surface to securely maintain said bearing assembly and axle end in said approximately fixed relationship.

10. A side frame of a railcar truck as claimed in claim 8 wherein said inner walls of said bearing adapter first and second depending legs and said roof are machined and cooperate to define a finished tolerance size distance between said depending leg inner walls to receive said bearing assembly and to provide said roof inner wall with an are contoured surface for mating with said bearing assembly.

11. A side frame of a railcar truck as claimed in claim 10 wherein said inner walls forming said bearing adapter each have a surface, said surfaces are treated by at least one of coating and flame spraying to provide said inner walls with a hardened surface.

* * * * *